US005345966A

United States Patent [19]

Dudley

[11] Patent Number: 5,345,966

[45] Date of Patent: Sep. 13, 1994

[54] POWERED DAMPER HAVING AUTOMATIC STATIC DUCT PRESSURE RELIEF

[75] Inventor: Kevin F. Dudley, Cazenovia, N.Y.

[73] Assignee: Carrier Corporation, Syracuse, N.Y.

[21] Appl. No.: 172,299

[22] Filed: Dec. 23, 1993

[51] Int. Cl.[5] ..... F16K 11/16

[52] U.S. Cl. ..... 137/601; 137/512.1; 454/325; 454/335

[58] Field of Search ..... 137/512.1, 601; 454/255, 259, 325, 335

[56] References Cited

U.S. PATENT DOCUMENTS

| | | | |
|---|---|---|---|
| 2,595,885 | 5/1952 | Rhoades | 454/325 X |
| 2,616,356 | 11/1952 | Cunningham | 454/259 |
| 2,965,014 | 12/1960 | Lowery | 454/259 X |
| 3,346,007 | 10/1967 | Agnon | 137/601 X |
| 4,487,214 | 12/1984 | Tatum | 137/601 X |
| 4,844,120 | 7/1989 | Myers | 137/601 |
| 4,962,882 | 10/1990 | Sarazen et al. | 137/601 X |
| 5,277,658 | 1/1994 | Goettl | 137/512.1 X |

*Primary Examiner*—Stephen M. Hepperle

[57] ABSTRACT

According to the present invention a damper for controlling the flow of conditioned air supplied through a supply duct to a conditioned space is provided. The damper includes a support housing which defines a flow passage which communicates the supply duct with the conditioned space. A plurality of damper blades are mounted within the support housing for pivotal movement about respective spaced apart parallel axes. A blade link interconnects the damper blades in a ganged relation so that a common pivoted orientation of the damper blades is determined by the position of the blade link. Means are provided for selectively exerting a force on the blade link which will either move the link toward the second position to increase the flow of air through the damper or for exerting a force on the blade link to move the link toward the first position to decrease the flow of air through the damper. Means are provided which allows the blade link to move toward the second position (maximum flow) in response to a force imparted on the damper blades by a build-up of pressure in the supply duct. Under such circumstances the force imparted upon the damper blades is sufficient to overcome the force exerted on the blade link to move the link toward said first position (flow substantially blocked).

6 Claims, 8 Drawing Sheets

POWERED DAMPER HAVING AUTOMATIC STATIC DUCT PRESSURE RELIEF

BACKGROUND OF THE INVENTION

1. Field of the Invention

This invention relates to dampers for use in heating, ventilating and air conditioning systems where conditioned air is provided from such a system to a plurality of zones, and, more particularly to a damper which provides automatic relief when an excessive duct pressure occurs.

2. Description of the Background Art

In conventional heating, ventilating and air conditioning ("HVAC") systems conditioned air is supplied to a plurality of zones. Zoning systems have been developed for these HVAC systems which typically include dampers disposed in the ductwork for controlling the air flow of the conditioned air to the zones. These zoning systems control the flow of conditioned air to the plurality of zones independently so as to allow for independent control of the zone environments.

However, these zoning systems are difficult and expensive to install, both as original equipment and as retrofit. Implementation of these systems typically requires the installation of dampers in the ductwork, installation of power and control wiring for the components of the system throughout the building, and installation of thermostats in the building walls. Retrofits typically include modifications to the ductwork, power and control wiring throughout the building, and thermostat installations in walls. Additionally, these zoning systems typically include an expensive and difficult installation of a bypass damper system which is used to relieve excess static duct pressure.

Excess static duct pressure may result when a large number of the dampers restrict the air flow to the zones. In one implementation of a bypass damper system, a bypass damper is connected between the supply and return air duct. An airflow sensor is disposed in the supply air duct and is connected to the bypass damper. A bypass controller is also connected to the bypass damper and is used to modulate the bypass damper in response to the airflow measured by the airflow sensor. Thus, if the bypass controller determines that the air flow to the supply air duct causes excess static duct pressure then the bypass damper will be used to recycle the conditioned air to the return air duct. This implementation has the disadvantage of being expensive and difficult to install. Additionally, recycling the conditioned air can cause the HVAC system to overload. For example, if the HVAC system is set in heat mode and the bypass damper is activated to relieve excess pressure in the duct, the recycled heated air may continue to increase in temperature, as it recycles, which may cause a limit switch to shut down the HVAC system. Elimination of the aforementioned bypass damper system would reduce the amount of HVAC system equipment which in turn would reduce installation and maintenance costs.

Another implementation of a bypass damper system is similar to the bypass system mentioned above with the exception that the conditioned air is redirected to a dump, such as an equipment room, instead of being recycled to the intake duct. This implementation has the additional disadvantage of lost efficiency because the energy used to condition the redirected conditioned air is wasted.

DISCLOSURE OF THE INVENTION

It is an object of the present invention to provide an inexpensive and easy to install zoning system damper for use in providing conditioned air to a plurality of zones.

It is a another object of the present invention to provide an inexpensive and automatic means to relieve excessive static duct pressures which occur, for example, in zoning systems if too many zone dampers are closed.

According to the present invention a damper for controlling the flow of conditioned air supplied through a supply duct to a conditioned space is provided. The damper includes a support housing which defines a flow passage which communicates the supply duct with the conditioned space. A plurality of damper blades are mounted within the support housing for pivotal movement about respective spaced apart parallel axes. A blade link interconnects the damper blades in a ganged relation so that a common pivoted orientation of the damper blades is determined by the position of the blade link. The blade link is moveable to any position which lies between a first position wherein the damper blades cooperate with one another so that air flow through the passage is substantially blocked and a second position wherein air flow through the passage is at a maximum. Means are provided for selectively exerting a force on the blade link which will either move the link toward the second position to increase the flow of air through the damper or for exerting a force on the blade link to move the link toward the first position to decrease the flow of air through the damper. Means are provided which allows the blade link to move toward the second position (maximum flow) in response to a force imparted on the damper blades by a build-up of pressure in the supply duct. Under such circumstances the force imparted upon the damper blades is sufficient to overcome the force exerted on the blade link to move the link toward said first position (flow substantially blocked).

The foregoing and other objects, features and advantages of the present invention will become more apparent in light of the following detailed description and accompanying drawings.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts, and wherein;

FIG. 12 is a flow chart for a main control.

DETAILED DESCRIPTION OF THE PREFERRED EMBODIMENT

Figure 1:
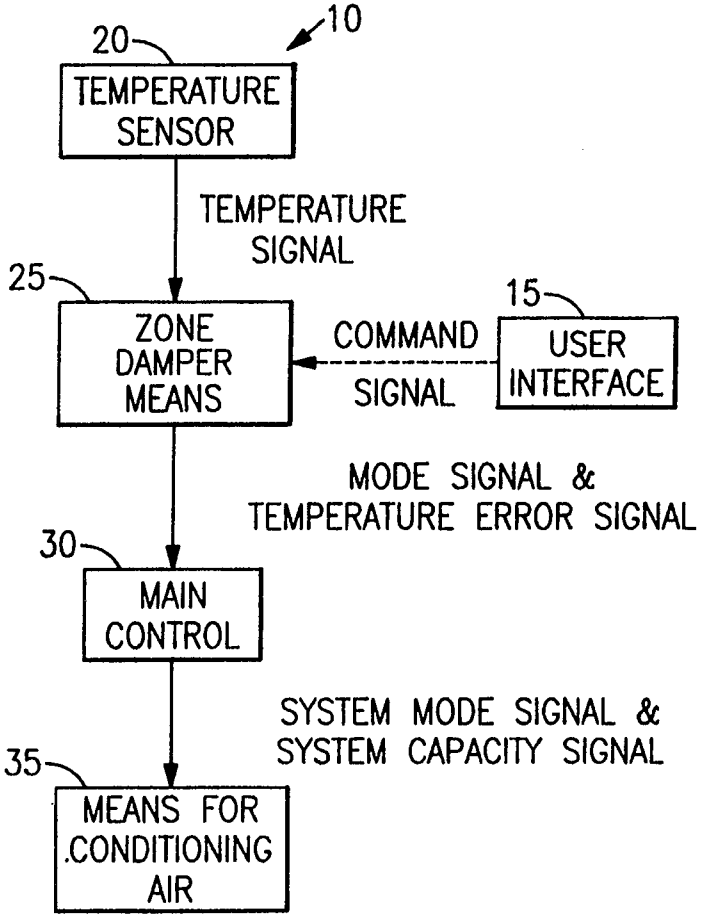
FIG. 1 is a schematic block diagram showing a zoning system making use of the damper of the present invention connected to a HVAC system.

Referring now in detail to the drawings, FIG. 1 is a block diagram illustrative of a zoning system 10 of the type for use with the present invention. The major components which make up the system include a user interface 15, a temperature sensor 20, a zone damper means 25, and a main control 30. A means for conditioning air 35 which is a component of the HVAC system and controlled by the present invention is also shown.

The user interface 15 can be any device which allows a user to select temperature setpoints and system operating modes. For example, a hand held infra-red remote control may be used, such as the Sanwa CES0110032-00. The user may select the setpoint and operating mode to achieve the desired zone temperature. One user interface may be employed and carried from zone to zone, or multiple user interfaces may be employed, one in each zone as desired.

The temperature sensor 20 may be any device which produces an output responsive to its surrounding temperature, such as the MCI 10K THERMISTOR. The temperature sensor 20 may be attached to a wall in a zone with a screw or, self adhesive pad, or any conventional securing means.

The zone damper means 25 controls the flow of conditioned air to the zones and, according to the invention, provides an automatic and inexpensive means to relieve excess static duct pressure. The zone damper means 25 is disposed at each zone outlet in the zones which receive conditioned air.

The main control 30 is used to control the system mode and equipment capacity (for variable capacity equipment) of the HVAC system. The HVAC system may be any ducted system which supplies conditioned air to a plurality of zones.

Figure 2:
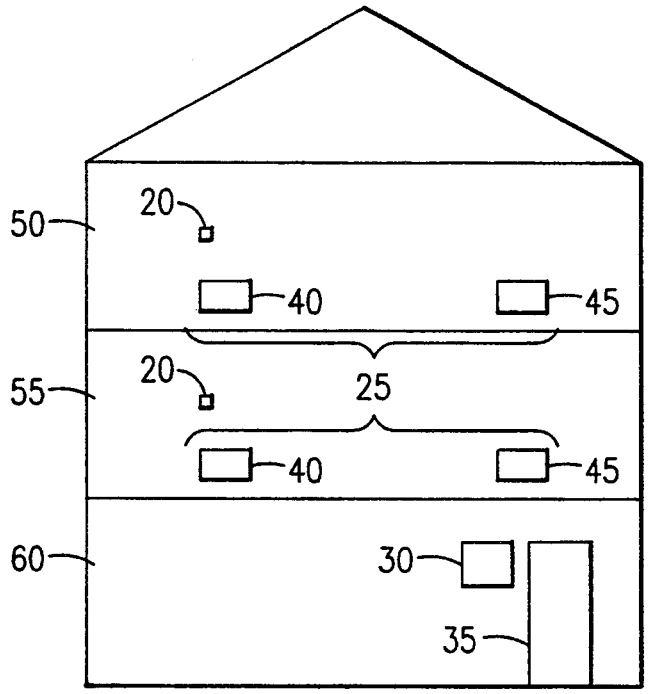
FIG. 2 is a simplified illustration of the zoning system making use of the damper of the present invention in a building.

FIG. 2 shows a zoning system arranged in a two zone structure which includes a zone damper means 25 including master zone dampers 40 and slave zone dampers 45. In the illustrated embodiment each zone damper means 25 includes a master zone damper 40 and a slave zone damper 45. It should be understood, that any one zone damper means 25 may include only a master zone damper 40, or alternatively may include a master zone damper 40 and one or more slave zone dampers 45. In both zone 50 and zone 55, a master zone damper 40, a slave zone damper 45, and a temperature sensor 20 are shown. The main control 30 and a means for conditioning air 35 are both shown in an equipment room 60. The means for conditioning air 35 is a conventional component of the HVAC system which conditions the air and supplies the conditioned air to an air distribution system which supplies the conditioned air to the plurality of zones. Typically, the means for conditioning air 35 has several system modes such as auto, heat, cool, fan and off modes. The means for conditioning air 35 may have variable capacity capability or fixed capacity capability.

Figure 3:
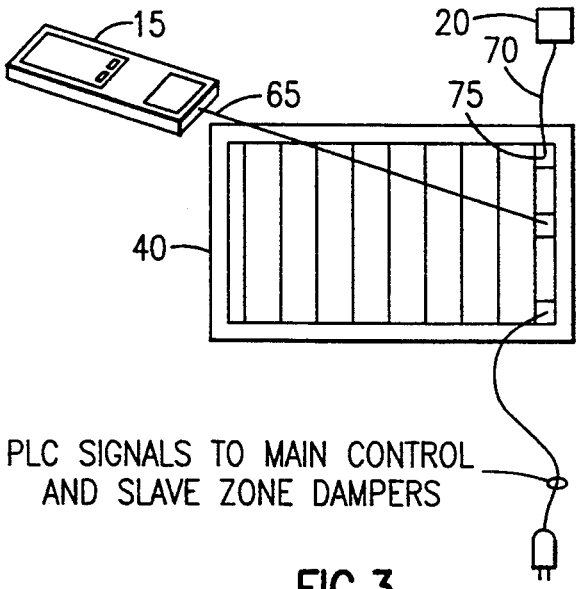
FIG. 3 shows the master zone damper, an infrared remote control, and a zone temperature sensor.

Referring to FIGS. 1 and 3, the user interface 15 transmits a command signal to the master zone damper 40 which is responsive to the command signal in a manner which will be described in more detail hereinbelow. The user interface 15, for example, may transmit the command signal by way of an infrared light beam 65, or alternatively, a radio frequency signal. The command signal includes a temperature setpoint and an operating mode signal; both of which the user controls from the user interface 15. The operating mode signal represents a request, from the respective zone, to the HVAC system for auto, heat, cool, fan or off mode. The setpoint signal represents the desired temperature for that particular zone.

The temperature sensor 20 is connected to the master zone damper 40 by way of a thin cord 70 which couples with a sensor plug 75 located on the damper 40. As will be more fully understood as the description of the system continues, the master zone damper 40 receives, and is responsive to, a temperature signal from the temperature sensor 20. The temperature signal represents the actual temperature in the zone in which a sensor 20 is located.

Referring now to FIGS. 1, 2 and 3, the master zone damper 40 transmits a damper position signal to the slave zone dampers 45. The damper position signal controls the position of the flow control mechanism of the slave zone dampers 45, such that the master zone dampers 40 control the air flow of conditioned air to the zones though the slave zone dampers 45. The master zone dampers 40 also transmit an operating mode signal and a temperature related control signal to the main control 30. The operating mode signal is set by the user as described above. The temperature related control signal is calculated by the master zone damper 40 and may be a temperature error signal which is the difference between the zone setpoint temperature selected by the user and the actual zone temperature.

Figure 6:
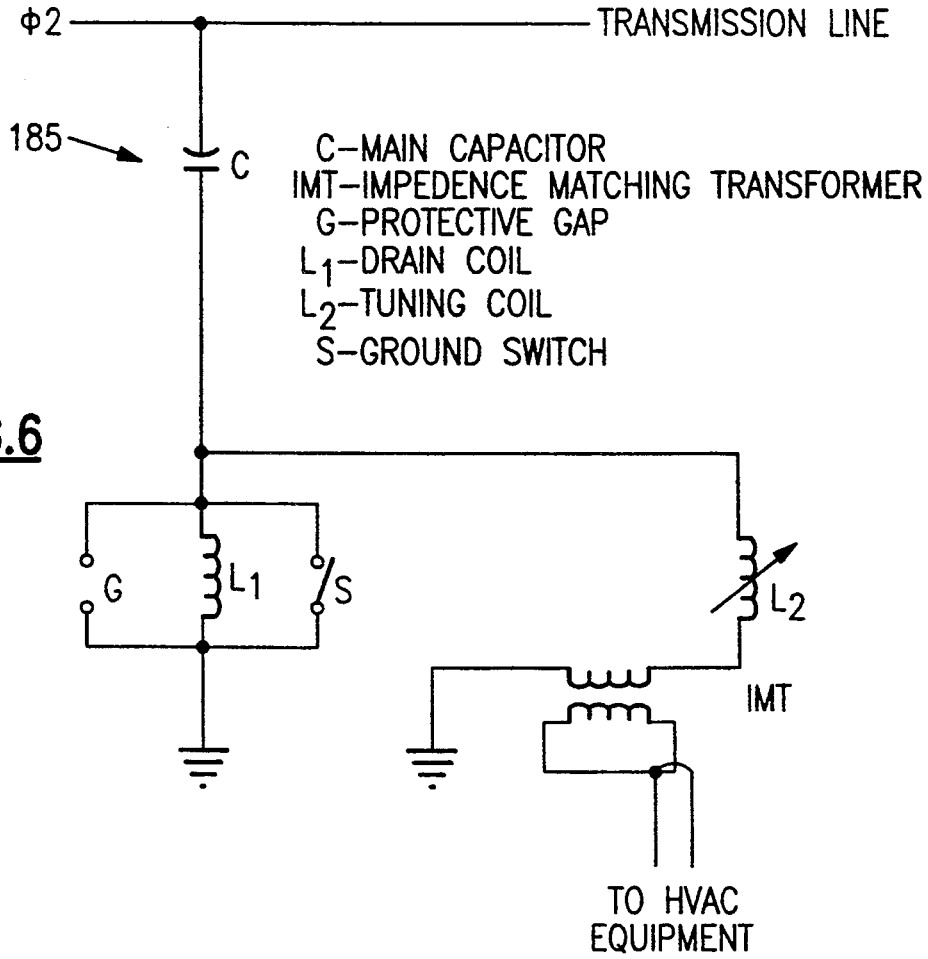
FIG. 6 is a schematic representation of a PLC circuit.

In the illustrated embodiment the damper position signal, the operating mode signal, and the temperature error signal are transmitted by a power line carrier ("PLC") means (shown in FIG. 6). Such a circuit is well known in the art and no further description of the circuit, which allows information to be transmitted across a power line, is considered necessary for a full understanding of the present invention. It should be readily apparent to someone skilled in the art that these signals could be transmitted by means of radio frequency ("RF") or by hardwiring the relevant system components.

Referring to FIGS. 1 and 2, the main control 30 is connected to a means for conditioning air 35 and is responsive to the operating mode signal and the temperature error signal from the master zone damper 40 such that the main control 30 provides the HVAC system with a system mode signal and a system capacity signal as will be appreciated as the system operation is described below.

Figure 4:
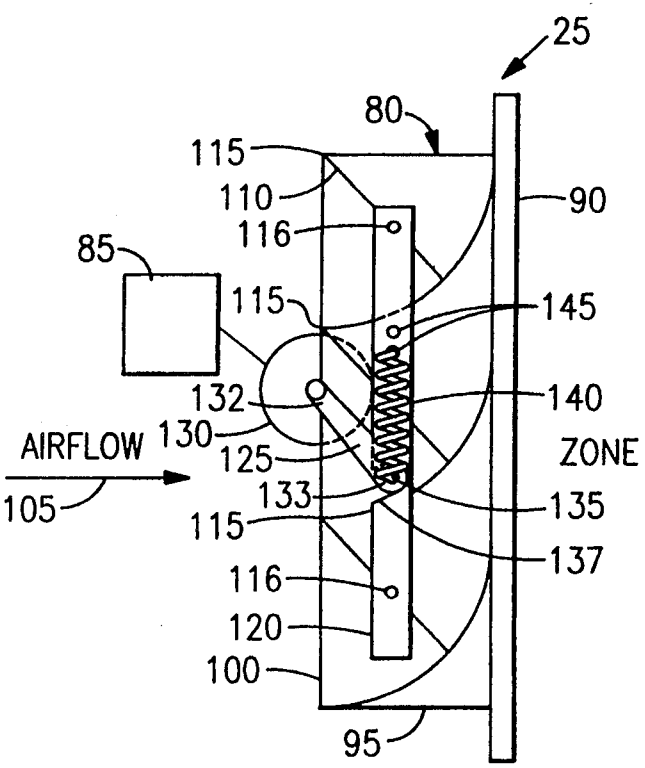
FIG. 4 is a side sectional view of a zone damper according to the present invention.
Figure 4A:
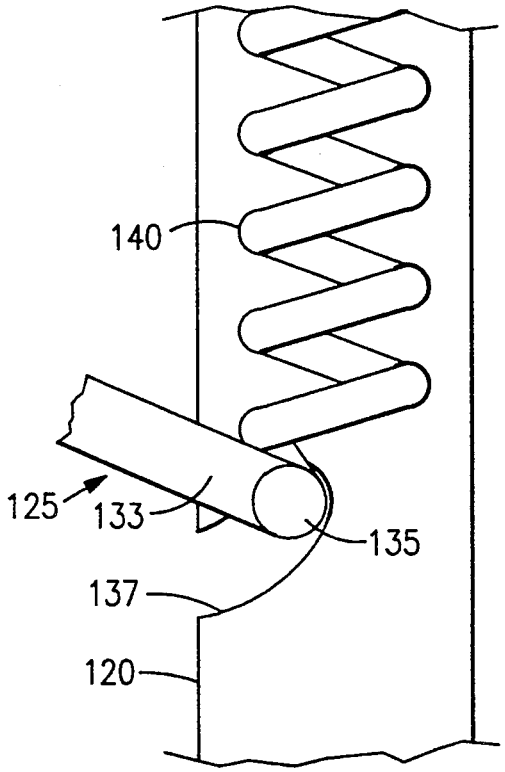
FIG. 4A is a magnified view of a portion of FIG. 4 showing a slot in a blade link cooperating with an arm pin.

Referring now to FIGS. 4 and 4A, the zone damper means 25 includes a zone damper assembly 80, zone damper circuitry 85, and a motor 130 for opening and closing the zone damper assembly 80, in response to inputs from the zone damper circuitry, as will be described hereinbelow. The zone damper assembly 80 of the type for use with the present invention is common to both the master zone damper 40 and the slave zone damper 45 and is shown in simplified form. While the zone damper circuitry is generally designated by reference numeral 85, it will be seen that the master zone damper circuitry 150 (shown in FIG. 5) is different from the slave zone damper circuitry 270 (shown in FIG. 8). The damper assembly 80 is sized such that it may be operatively installed in place of a conventional conditioned air outlet diffuser in a typical air distribution system.

The damper assembly 80 includes an outside grill 90 which is attached to a support housing 95. The housing 95, shown only in outline, may be formed from sheet metal or other suitable material. Operatively mounted to the support housing 95 are a plurality of damper blades 110. Each of the damper blades 110 is pivotally mounted about a pivot point 115 in the support housing 95 for movement from a substantially vertical position, wherein the air flow through the damper is blocked, to a horizontal position wherein the air flow through the damper is at a maximum. Each damper blade 110 is shown in an intermediate position in FIG. 4.

The damper blades 110 are interconnected with one another at an intermediate pivot point 116 thereof by a vertically extending blade link 120. As a result the blade link 120 moves vertically and horizontally, as the blades 110 move, together in a ganged relationship, about their respective pivot points 115. An arcuately shaped slot 137 is provided in the left hand side of the blade link 120, as viewed in the drawing figures, for operationally cooperating with the damper assembly 25 to open the damper blades 110 as will be described hereinbelow. An actuating arm 125 couples the blade link 120 to the motor 130 such that as the actuating arm 125 is turned by the motor 130 the blade link 120 causes the damper blades 110 to open or close. One end 132 of the actuating arm 125 is connected to the motor 130. As best shown in FIG. 4A a pin 135 is mounted to the other end 133 of the actuating arm 125. The pin 135 is sized such that it is received in and operationally engages, the slot 137 on the blade link 120, as the actuating arm 125 moves counter clockwise. As a result the blade link 120 is caused to move upwardly and to the right, which, in turn, opens the damper blades 110.

A coil spring 140 is connected at one end to the arm pin 135 such that the spring 140 is operationally disposed at the second end 133 of the actuating arm 125. The other end of the spring 140 is connected to a pin 145 mounted on the blade link 120 at a location above the slot 137. The spring 140, as so mounted, is in tension and, as a result, as the actuating arm 125 turns clockwise the spring 140 pulls on the blade link 120 to close the damper blades 110. Thus, the spring 140 is used to regulate the closing motion of the damper blades 110. It should be understood by one skilled in the art that a solenoid may be used in place of the motor 130.

This arrangement provides automatic pressure relief which prevents excessive static duct pressures. For example, if the force against the damper blades 110, caused by the static pressure in the duct, is higher than the spring force, the blades 110 will swing open against the spring force to relieve the static duct pressure. The spring force may be adjusted by moving the end of the spring 140 to different blade link pins 145 corresponding to different calibrated pressure relief settings. Thus, the spring 140 is used to regulate the opening motion of the damper blades 110 caused by excess static pressure. As will now be described in detail the zone damper circuitry 85 is used to control motion of the motor 130.

Figure 5:
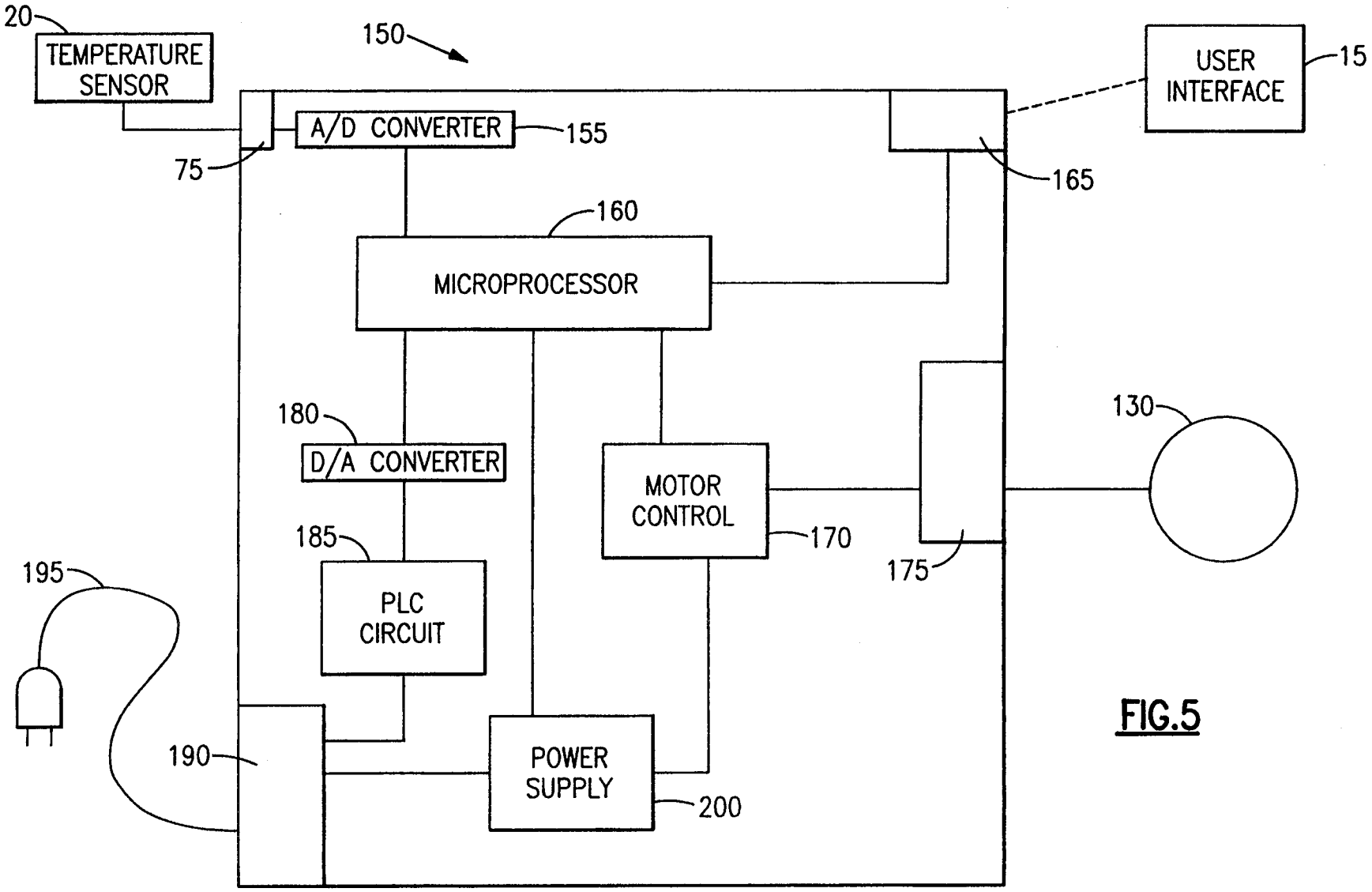
FIG. 5 is a block diagram of a master zone damper circuitry.

FIG. 5 shows a block diagram of the master zone damper circuitry 150. The master zone damper circuitry 150 comprises a sensor plug 75, an a/d converter 155, a microprocessor 160, a user interface receiver 165, a motor control 170, motor control terminals 175, a d/a converter 180, a PLC circuit 185, power line terminals 190, a power cord 195, and a power supply 200, all electrically connected as shown.

The temperature sensor 20 is connected to the sensor plug 75 such that the sensor plug 75 receives the temperature signal. The sensor plug 75 is connected to the a/d converter 155 and the a/d converter 155 is connected to the microprocessor 160 such that the a/d converter 155 converts the temperature signal to a digital temperature signal which is transmitted to the microprocessor 160. A Harris CDP68HC68A2 may be used for the a/d converter 155 and an Intel 80C52 may be used for the microprocessor 160. The user interface receiver 165, which is connected to the microprocessor 160, is used to receive the command signal from the user interface 15 and transmit the command signal to the microprocessor 160. The microprocessor 160 also is connected to the serially connected combination of the motor control 170, motor control terminals 175, and the damper motor 130 such that the microprocessor 160 causes the motor control 170 to operationally regulate the damper motor 130 for opening or closing the damper blades 110. An Allegro UNC58D4B may be used for the motor control 170. The microprocessor 160 is also connected to the serially connected combination of the d/a converter 180, the PLC circuit 185, the power line terminals 190, and the power cord 195 for allowing the master zone damper 40 to transmit signals across the power line to the slave zone dampers 45 and the main control 30. A Harris AD7520 may be used for the d/a converter 180. One known embodiment of the PLC circuit 185 is shown in FIG. 6. The power supply 200 is used to provide electrical energy to the master zone damper circuitry 150.

Figure 7:
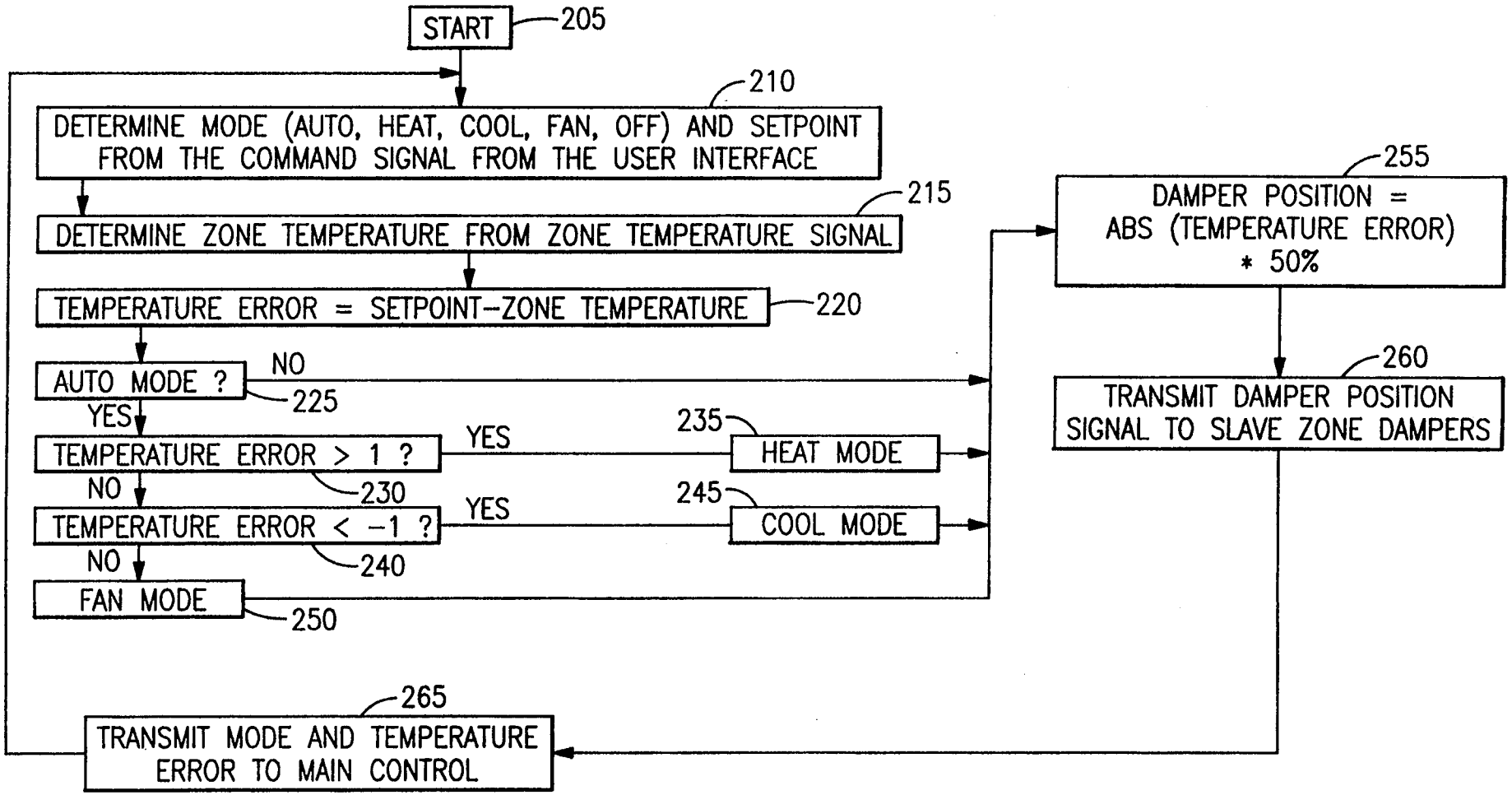
FIG. 7 is a flow chart for a master zone damper.

Referring to FIG. 7, the logic programmed into the microprocessor 160 in the master zone damper circuitry 150 is illustrated. Beginning at the block 205 labeled "start" the first step performed 210 is to determine the mode and setpoint from the command signal from the user interface 15. The next step 215 is to determine the zone temperature from the temperature signal. Then in step 220, the zone temperature is subtracted from the setpoint to determine the temperature error. If the mode is set to auto mode the microprocessor moves to step 230 where, if the temperature error is greater than one (1) the heat mode is selected in step 235. If the temperature error is less than negative one (−1) the cool mode is selected in step 245. If the temperature error is between one (1) and negative one (−1) the microprocessor 160 moves to step 250 and the fan mode is selected.

After the proper mode is selected the microprocessor 160 moves to step 255 and determines the damper position as the absolute value of the temperature error multiplied by fifty percent (50%). The damper position is limited to a value of 100% which corresponds to a fully opened damper. The damper position is transmitted to the motor control 170 (shown in FIG. 5) causing the damper motor 130 to adjust the damper blades 110

(shown in FIG. 4) on the master zone dampers 40 to the position indicated by the damper position step 260. The microprocessor 160 also transmits the damper position to the d/a converter 180 which transmits the damper position to the PLC circuit 185 which in turn transmits the damper position to the slave zone dampers 45 through the power line. The slave zone dampers 45 use the damper position to adjust the damper blades 110 (shown in FIG. 4) on the slave zone dampers 45 to the position indicated by the damper position step 260. The microprocessor 160 in step 265 transmits the operating mode signal and the temperature error signal to the d/a converter 180 which transmits these signals to the PLC circuit 185 which in turn transmits these signals to the main control 30 through the power line.

Referring to step 225, if the auto mode is not selected then the process is the same as above with the exception that at step 225 the microprocessor 160 moves directly to step 255, instead of to step 230. When the auto mode is not selected, the mode selected by the user, such as heat, cool, fan, or off is transmitted in step 265 to the main control 30.

Figure 8:
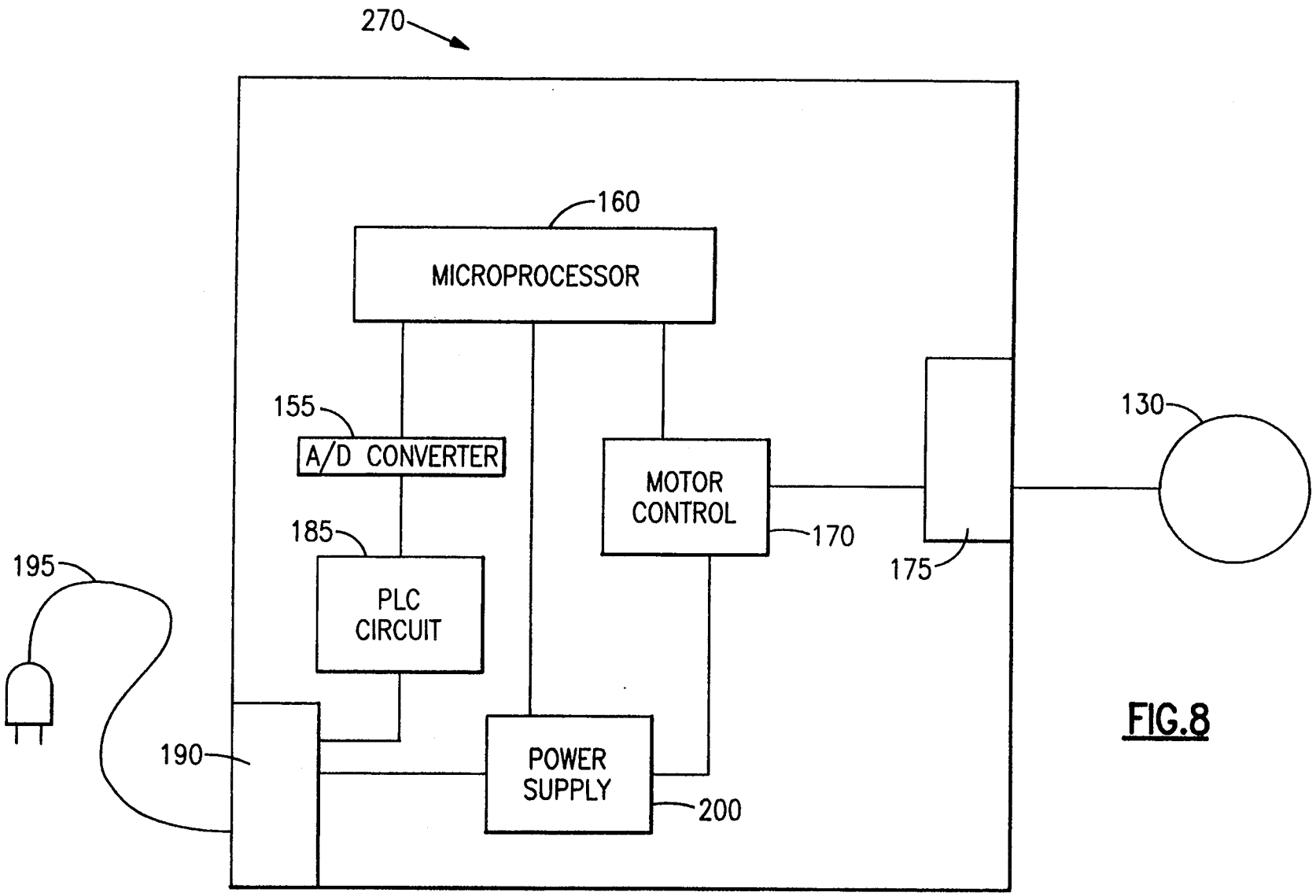
FIG. 8 is a block diagram of a slave zone damper circuitry.

FIG. 8 shows a block diagram of the slave zone damper circuitry 270. The slave zone damper circuitry 270 comprises a microprocessor 160, an a/d converter 155, a PLC circuit 185, power line terminals 190, a power cord 195, a motor control 170, motor control terminals 175, and a power supply 200, all electrically connected as shown.

The microprocessor 160 is connected to the serially connected combination of the a/d converter 155, the PLC circuit 185, the power line terminals 190, and the power cord 195 for receiving the damper position signal transmitted across the power line from the master zone damper 40. A Harris CDP68HC68A2 may be used for the a/d converter 155 and an Intel 80C52 may be used for the microprocessor 160. One known embodiment of the PLC circuit 185 is shown in FIG. 6. The microprocessor 160 is also connected to the serially connected combination of the motor control 170, motor control terminals 175, and the damper motor 130 such that the microprocessor 160 causes the motor control 170 to regulate the damper motor 130 for opening or closing the damper blades 110. An Allegro UNC58D4B may be used for the motor control 170. The power supply 200 is used to provide electrical energy to the slave zone damper circuitry 270.

Figure 9:
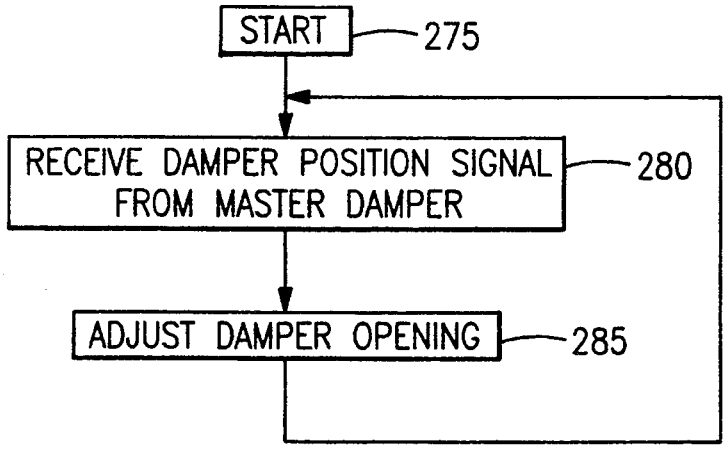
FIG. 9 is a flow chart for a slave zone damper.

Referring to FIG. 9, the logic programmed into the microprocessor 160 in the slave zone damper circuitry 270 is illustrated. Beginning at the block 275 labeled start, the first step performed 280 is to receive the damper position signal from the master zone damper 40 using the above mentioned PLC circuit 185. In step 285 the damper position signal is transmitted to the motor control 170 (shown in FIG. 8) for causing the damper motor 130 to adjust the damper blades 110 (shown in FIG. 4) on the slave zone dampers 40 to the position indicated by the damper position signal.

Figure 10:
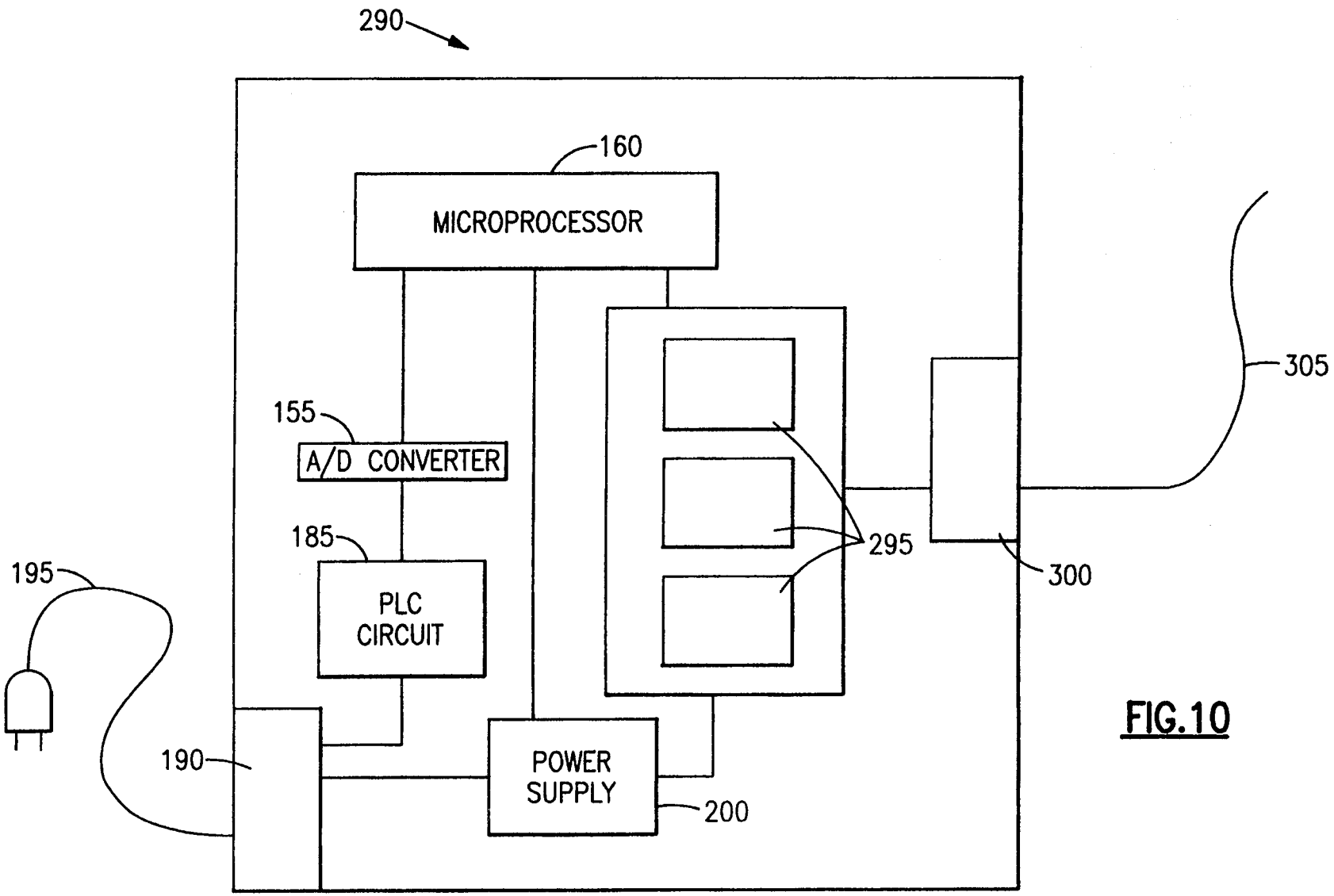
FIG. 10 is a block diagram of a main control circuitry for fixed capacity equipment.

The main control 30 may be used for a variable capacity or a fixed capacity HVAC system. Shown in FIG. 10 is a block diagram of the main control circuitry 290 for a fixed capacity HVAC system. The main control circuitry 290 for a fixed capacity HVAC system comprises a microprocessor 160, an a/d converter 155, a PLC circuit 185, power line terminals 190, a power cord 195, relays 295, signal terminals 300, control wiring 305, and a power supply 200.

The microprocessor 160 is connected to the serially connected combination of the a/d converter 155, the PLC circuit 185, the power line terminals 190, and the power cord 195 for receiving the system mode and the system capacity signals transmitted across the power line from the master zone damper 40. A Harris CDP68HC68A2 may be used for the a/d converter 155 and an Intel 80C52 may be used for the microprocessor 160. One known embodiment of the PLC circuit 185 is shown in FIG. 6.

The microprocessor 160 also is connected to the serially connected combination of the relays 295, the signal terminals 300, the control wiring 305, and the means for conditioning air 35 for controlling the system mode of the means for conditioning air 35. The power supply 200 is used to provide electrical energy to the main control circuitry 290.

Figure 11:
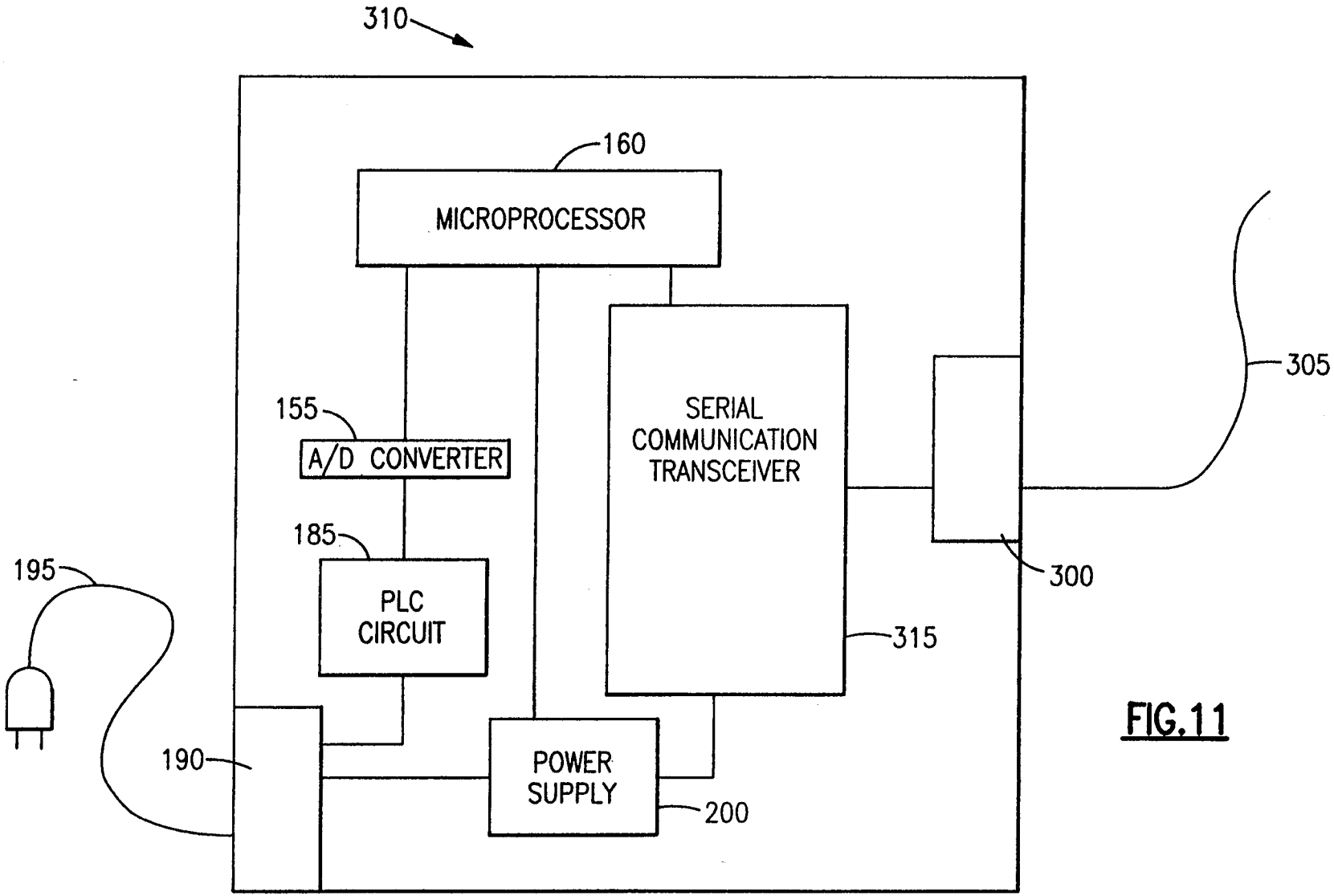
FIG. 11 is a block diagram of a main control circuitry for variable capacity equipment.

Shown in FIG. 11 is a block diagram of the main control circuitry 310 for a variable capacity HVAC system. The main control circuitry 310 for a variable capacity HVAC system comprises a microprocessor 160, an a/d converter 155, a PLC circuit 185, power line terminals 190, a power cord 195, a serial communication transceiver 315, signal terminals 300, control wiring 305, and a power supply 200.

The microprocessor 160 is connected to the serially connected combination of the a/d converter 155, the PLC circuit 185, the power line terminals 190, and the power cord 195 for receiving the system mode and the system capacity signals transmitted across the power line from the master zone damper 40. A Harris CDP68HC68A2 may be used for the a/d converter 155 and an Intel 80C52 may be used for the microprocessor 160. One known embodiment of the PLC circuit 185 is shown in FIG. 6. The microprocessor 160 also is connected to the serially connected combination of the serial communication transceiver 315, the signal terminals 300, the control wiring 305, and the means for conditioning air 35 for controlling the system mode and the system capacity of the means for conditioning air 35. A linear LTC485 may be used for the serial communication transceiver. The power supply 200 is used to provide electrical energy to the main control circuitry 310.

Referring to FIG. 12, the logic programmed into the microprocessor 160 in the main control circuitry 290, 310 for both a fixed capacity and a variable capacity HVAC system is illustrated. Beginning at the block 320 labeled "start", the first step performed 325 is to receive the operating mode and temperature error signals from the master zone dampers 40. In step 330 it is determined if there are any zones calling for heating or cooling from the information in the received operating mode signals. If there are no heat or cool zones then the microprocessor 160 moves to step 335 to determine, from the operating mode signal, if there are any fan zones. If no fan zones exist then the system mode is set to "off" in step 340. If at least one fan zone exists, then the system mode is set to fan mode in step 345.

If in step 330 it was determined that there is at least one heat and/or cool zones then the microprocessor 160 moves to step 350 to determine if the number of heat zones is equal to the number of cool zones. If the number of heat zones is equal to the number of cool zones the microprocessor 160 moves to step 355 and sets the system mode to the mode of the zone with the largest absolute temperature error. If in step 350 the number of heat zones is not equal to the number of cool zones the microprocessor 160 moves to step 360 and sets the system mode to the mode with the larger number of zones. Once the system mode is determined it is transmitted to the means for conditioning air 35 in step 365. In step 370 the microprocessor 160 determines whether the HVAC system is a fixed capacity system or a variable capacity system. If the HVAC system is a fixed capacity system the microprocessor 160 moves back to step 320. If the HVAC system is a variable capacity system then the microprocessor 160 moves to step 375 and sets the system capacity according to the following formula. System capacity=((100%/2 Deg. F.)/(Total No. of Zones)) * (Sum of ABS(Temperature Error) of zones with System Mode). In step 380, the system capacity is transmitted to the means for conditioning air as described above and the microprocessor 160 moves back to step 320.

The following is an example of the operation of the present invention in a two zone environment. Assume zone 1 has a temperature of 71.5 degrees, zone 2 has a temperature of 72 degrees and that the user has selected auto mode and a setpoint of 70 degrees for both zone 1 and zone 2. Also assume that the HVAC system has a variable capacity and that both zone 1 and zone 2 each have one master zone damper 40 and one slave zone damper 45.

Referring to FIG. 7, the master zone dampers 40 in zone 1 and zone 2 determine that the auto mode and a setpoint of 70 degrees are selected in step 210. In step 215, the master zone dampers 40 determine a zone 1 temperature of 71.5 and a zone 2 temperature of 72 degrees. The microprocessor 160 calculates the temperature errors in step 220; in zone 1 the temperature error is −1.5 and in zone 2 the temperature error is −2. The cool mode for both zone 1 and zone 2 is selected in step 245 because both temperature errors are less than −1 and the auto mode was selected in both zones. Next, the microprocessor 160 calculates the damper position to be the absolute value of the temperature error multiplied by 50%; the damper position in zone 1 is 75% and the damper position in zone 2 is 100%. The master zone damper 40 uses the damper positions to adjust the damper blades 110 on the master zone dampers 40 to a corresponding position. For example, the zone 1 damper position will adjust to a 75% open position. The damper position signals are transmitted to the respective slave zone dampers 45 in step 260 and the operating mode and temperature error signals are transmitted to the main control 30 in step 265.

Referring to FIG. 9, each slave zone damper 45 receives the damper position signal from its respective master zone damper 40 in step 280 which is used, in step 285, to adjust the respective slave zone damper openings to the above mentioned positions.

Referring to FIG. 12, the main control 30 receives the operating mode and temperature error signals from the master zone dampers 45 in step 325. Since there are two cool zones and no heat zones, the microprocessor 160 moves to step 360 to calculate the system mode. In step 360, the microprocessor 160 sets the system mode to the cool mode, which is the mode with the maximum number of zones. The system mode is sent to the means for conditioning air 35 so as to set the means for conditioning air 35 to the cool mode. In this example, the microprocessor 160 moves to step 375 because the HVAC system has a variable capacity. The system capacity is calculated as ((100%/2 degrees F.)/(2)) * 3.5 in step 375. Thus, the system capacity, in this example, is calculated as 87.5% and in step 380 is transmitted to the means for conditioning air 35 so that the means for conditioning air 35 is adjusted to 87.5% of its maximum capacity.

Although the invention has been shown and described with respect to a best mode embodiment thereof, it should be understood by those skilled in the art that various other changes, omissions and additions in the form and detail thereof may be made therein without departing from the spirit and scope of the invention as set forth in the attached claims.

What is claimed is:

1. A damper for controlling the flow of conditioned air, supplied through a supply duct, to a conditioned space, comprising;

a support housing defining a flow passage which communicates said supply duct with said conditioned space;

a plurality of damper blades supported by said housing, in said flow passage, for pivotal movement about respective spaced apart parallel axes;

a blade link interconnecting said damper blades in a ganged relation so that a common pivoted orientation of the damper blades is determined by the position of the blade link, said blade link being movable to any position between a first position wherein said damper blades cooperate with one another so that air flow through said passage is substantially blocked, and, a second position wherein air flow is at a maximum;

means for selectively exerting a force on said blade link to move said link toward said second position to increase the flow of air through said damper, or, for exerting a force on said blade link to move said link toward said first position to decrease the flow of air through said damper; and means for allowing said blade link to move toward said second position, in response to a force imparted on said damper blades by a build-up of pressure in the supply duct, said imparted force being sufficient to overcome said force exerted on said blade link to move said link toward said first position.

2. The apparatus of claim 1 wherein said means for allowing said blade link to move toward said second position comprises, a resilient element interposed between said means for selectively exerting a force on said blade link toward said second position, and, said blade link.

3. The apparatus of claim 2 wherein said means for selectively exerting a force comprises;

an electrically actuatable device for imparting a reversible rotary motion;

an actuating arm, having one end thereof attached to said electrically actuatable device in a manner such that said rotary motion is imparted to said actuating arm, the other end of said actuating arm being adapted to positively engage said blade link when rotating in one direction, to exert said force thereon to move said blade link toward said first position, and, to engage said blade link, through said resilient element, when rotating in the other direction to exert said force thereupon to move said blade link toward said second position.

4. The apparatus of claim 3 wherein said resilient means comprises a spring interconnecting said blade link and said actuating arm.

5. The apparatus of claim 3 wherein said actuating arm carries a pin at said other end thereof, and wherein said blade link is provided with a slot adapted to operationally receive said pin to effect said positive engagement therewith when said blade link is rotating in one direction to exert said force thereon to move said blade link toward said first position; and, wherein said resilient element comprises a coil spring having one end thereof attached to said pin, and, the other end thereof attached to said blade link at a location spaced from said slot in the direction of said second position.

6. The apparatus of claim 5 wherein said blade link is provided with a plurality of spaced apart means for attaching said other end of said spring.

* * * * *